US007146880B1

(12) United States Patent
Francis et al.

(10) Patent No.: US 7,146,880 B1
(45) Date of Patent: Dec. 12, 2006

(54) TORQUE WRENCH SYSTEM

(75) Inventors: Dale L. Francis, Gretna, LA (US); William P. Bernard, Waggaman, LA (US); Oswald J. Bernard, Waggaman, LA (US)

(73) Assignee: Francis Services, Inc., Harvey, LA (US)

( * ) Notice: Subject to any disclaimer, the term of this patent is extended or adjusted under 35 U.S.C. 154(b) by 239 days.

(21) Appl. No.: 11/005,627

(22) Filed: Dec. 6, 2004

(51) Int. Cl.
*B25B 13/46* (2006.01)

(52) U.S. Cl. ..... 81/57.39; 81/57.44

(58) Field of Classification Search ..... 81/57.39, 81/57.42, 57.44, 57.45, 57.46, 57.13, 57.29, 81/60, 61
See application file for complete search history.

(56) References Cited

U.S. PATENT DOCUMENTS

| | | | |
|---|---|---|---|
| 1,812,816 | A | 6/1931 | Weaver |
| 1,871,857 | A | 8/1932 | Martois |
| 2,702,489 | A | 2/1955 | Wallace, Sr. |
| 2,720,803 | A | 10/1955 | Rice et al. |
| 2,758,493 | A | 8/1956 | Goldwater |
| 2,867,144 | A | 1/1959 | Stevens |
| 3,686,983 | A | 8/1972 | Flagge |
| 3,733,935 | A | 5/1973 | Tsuji |
| 3,739,659 | A | 6/1973 | Workman, Jr. |
| 3,745,858 | A | 7/1973 | Biach |
| 3,845,673 | A | 11/1974 | Karden et al. |
| 3,930,776 | A | 1/1976 | Keller |
| 3,939,924 | A | 2/1976 | Grabovac |
| 3,965,778 | A | 6/1976 | Aspers et al. |
| 4,027,561 | A | 6/1977 | Junkers |
| 4,079,641 | A | 3/1978 | Junkers |
| 4,201,099 | A | 5/1980 | Junkers |
| 4,300,641 | A | 11/1981 | Kinkel |
| 4,309,923 | A | 1/1982 | Wilmeth |
| 4,325,274 | A | 4/1982 | Martelee |
| 4,513,827 | A | 4/1985 | Dubiel |
| 4,522,269 | A | 6/1985 | Adman et al. |
| 4,669,338 | A | 6/1987 | Collins |
| 4,674,368 | A | 6/1987 | Surowiecki |
| 4,679,469 | A | 7/1987 | Coyle, Sr. |
| 4,722,252 | A | 2/1988 | Fulcher et al. |

(Continued)

FOREIGN PATENT DOCUMENTS

| | | |
|---|---|---|
| SU | 301266 | 9/1971 |

(Continued)

*Primary Examiner*—Jacob K. Ackun, Jr.
(74) *Attorney, Agent, or Firm*—Garvey, Smith, Nehrbass & North, L.L.C.; Brett A. North

(57) ABSTRACT

An improved hydraulic wrench including a one-piece housing in which one end of the housing forms internally a cylinder for hydraulically reciprocating power and the second end of the housing includes an opening in which a torque arm/ratchet mechanism can be pivotally connected by, for example, a square shaft. There is further included a piston shaft which has a fixed piston on the first end and the second end includes an elongated slot which provides a flat wall at 90 degrees of the reciprocating power source. The wall in the elongated slot allows the drive pin which connects the ratchet mechanism to the piston shaft to roll up and down during cycling of the tool, and provides a non-pivoting reciprocating power source as the piston shaft moves backward and forward during operation. There is included a ratchet wheel fixed to a square shaft for rotation therewith, a ratchet pawl on the drive lever and engaging the ratchet wheel to rotate the square shaft upon reciprocation of the piston shaft in the cylinder.

26 Claims, 17 Drawing Sheets

U.S. PATENT DOCUMENTS

| | | | | |
|---|---|---|---|---|
| 4,794,825 | A * | 1/1989 | Schmoyer | 81/57.39 |
| 4,819,520 | A | 4/1989 | Collins | |
| 4,898,248 | A | 2/1990 | Thompson | |
| 4,916,986 | A | 4/1990 | Junkers | |
| 5,005,654 | A | 4/1991 | Moriki et al. | |
| 5,097,730 | A | 3/1992 | Bernard et al. | |
| 5,186,262 | A | 2/1993 | Thompson | |
| 5,277,087 | A | 1/1994 | Wilson, Jr. et al. | |
| 5,381,709 | A | 1/1995 | Louw | |
| 6,279,427 | B1 | 8/2001 | Francis | |
| 6,311,585 | B1 * | 11/2001 | Jamra et al. | 81/57.39 |
| 6,382,059 | B1 | 5/2002 | Francis | |

FOREIGN PATENT DOCUMENTS

| | | |
|---|---|---|
| SU | 747709 | 7/1980 |
| WO | WO 87/05553 | 9/1987 |

* cited by examiner 340
340
365
70
365
200
200
240
660
650
610
580
600
530
690
720
540
560
170
550
590
580
590
880
590
590
590

TORQUE WRENCH SYSTEM

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to torquing systems. More particularly, the present invention relates to an improved torque hydraulic torque wrench system which includes various improvements for extended life and control of applied torque.

2. General Background of the Invention

Hydraulic torque wrenches are wrenches which are utilized in numerous industries requiring the tightening down of nuts with a very high torque in the magnitude of as high as 50,000 foot pounds. A particular line of wrenches, known as torque wrenches, have been developed, which are usually hydraulically controlled, and incorporate a ratcheting mechanism where the wrench can be hydraulically operated in order to achieve the high torque, yet operate as a ratcheting wrench in a more confined area.

U.S. Pat. No. 5,097,730, entitled "Inline Ratcheting Tool," incorporated herein by reference, explains the operation of a hydraulic torque wrench. U.S. Pat. No. 4,201,099 issued to Junkers, entitled "Hydraulic Wrench", incorporated herein by reference, discloses a piston type hydraulic wrench comprising a housing having a first portion and an elongated second portion integral with the first portion and forming a cylinder. Shown is a piston reciprocable in the cylinder, and a shaft having an axis extending transverse to the cylinder and mounted in the first housing portion with an end portion of the shaft projecting outwardly from the housing, and a piston shaft connected at one end to the piston, and at least one drive lever mounted in the region of one end turnable about the axis of the shaft means and connected at the other end of the piston shaft. This connection operates a ratchet wheel during operation. A review of the '099 patent as seen particularly in FIG. 4, indicates that during operation the piston shaft must move from its position transverse to the axis of the ratchet member. During such movement, a change occurs in the 90 degree relationship between the rod and the axis of the ratchet adversely impacting the wrench's torquing power and leading to a shortened wrench life.

Various problems exist with prior art wrenches. One problem includes the tendency of the drive pin, connecting the piston shaft to the ratchet member, to wear against the body of the torque wrench requiring replacement/refurbishing of the body portion.

Another problem includes the drive pin being deformed during use (by the high forces) required by operating conditions.

Another problem includes the drive pin being contacted by a relatively small surface area and increasing irregular localized deformation.

Another problem includes excessive variations in the applied torque during piston stroke.

BRIEF SUMMARY OF THE INVENTION

The apparatus of the present invention solves the shortcomings in the art in a simple and straight forward manner.

In one embodiment is provided an improved hydraulic wrench where wear on the body by the drive pin is lowered or minimized.

In one embodiment the drive plates resist movement of the drive pin to prevent the pin from wearing or scratching the body.

In one embodiment the drive pin and plates are configured to resist movement of the drive pin so that wear on the body is lowered or minimized.

In another embodiment is provided an improved hydraulic wrench where distortion of the drive pin is minimized by support from the drive pawl.

In another embodiment is provided an improved hydraulic wrench where localized stresses between the piston and drive pin are reduced or minimized by increasing the contact area between the piston and drive pin.

In another embodiment is provided an improved hydraulic wrench where variances in the torque during the stroke of the piston are reduced or minimized.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
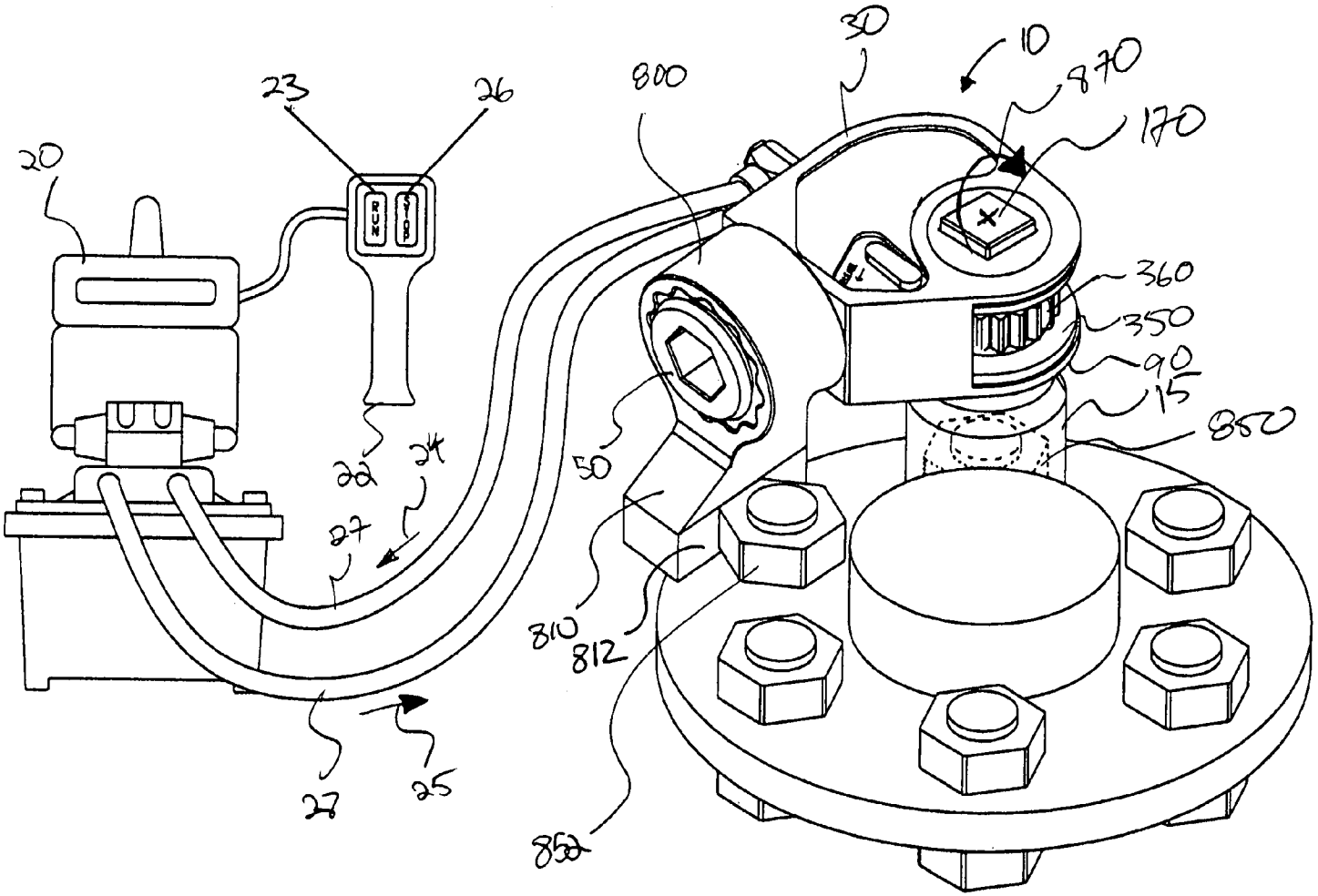
FIG. 1 is an overall perspective of a preferred embodiment shown in loosening a nut or bolt.
Figure 1A:
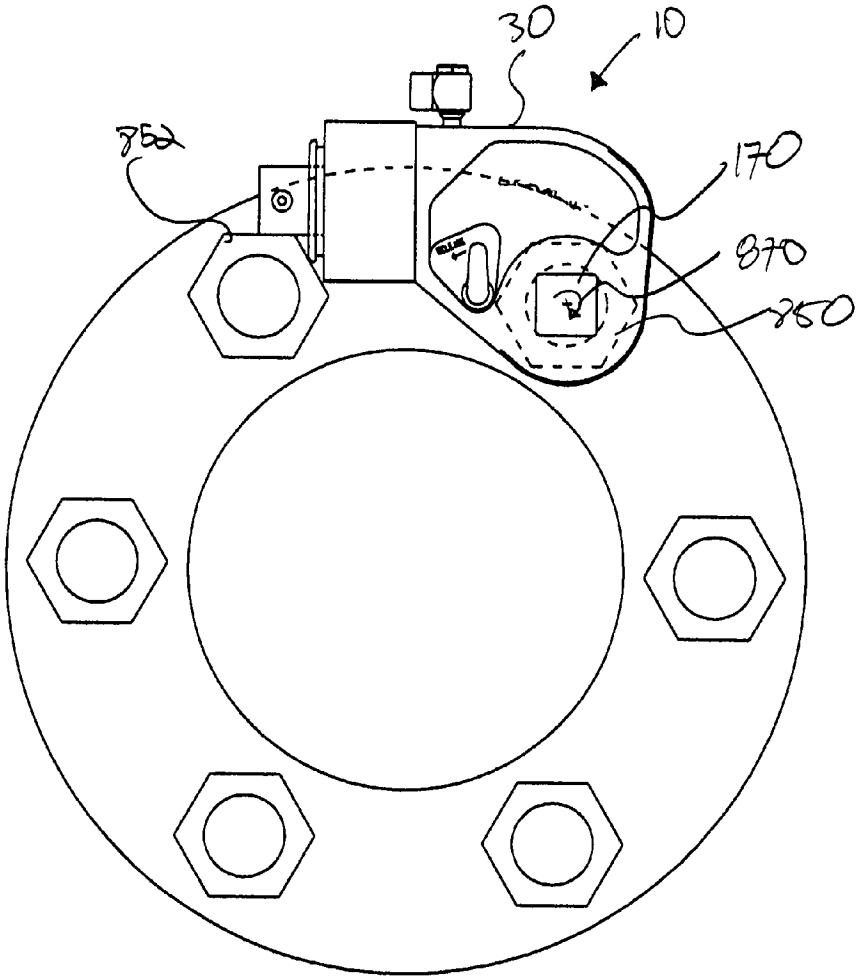
FIG. 1A is a top view of the wrench in FIG. 1.

FIG. 1 is an overall perspective of a preferred embodiment for torque wrench 10 shown loosening a nut or bolt 850. Hydraulic fluid source 20 is shown powering torque wrench 10. Controller 22 can be used to control hydraulic fluid source 20. On/off switch 26 can turn hydraulic power to fluid source 20 on and off. When power is on and toggle switch 23 is not depressed fluid can be pumped in line 28 in the direction of arrow 25 (with fluid returning via line 27 in the direction of arrow 24). When toggle switch 23 is depressed fluid flow is switched with fluid flowing into line 27 in the opposite direction of arrow 24 and fluid returning in line 28 in the opposite direction of arrow 25. Shaft 170 will be turned in the direction of arrow 870 causing socket 15 to turn threaded fastener 850. In this process a reaction torque will be generated tending to rotate wrench 10 in the opposite direction of arrow 870. To oppose this reaction torque reaction bar 800 will contact threaded fastener 852. FIG. 1A is a top view of torque wrench 10 tightening threaded fastener 850.

Figure 2:
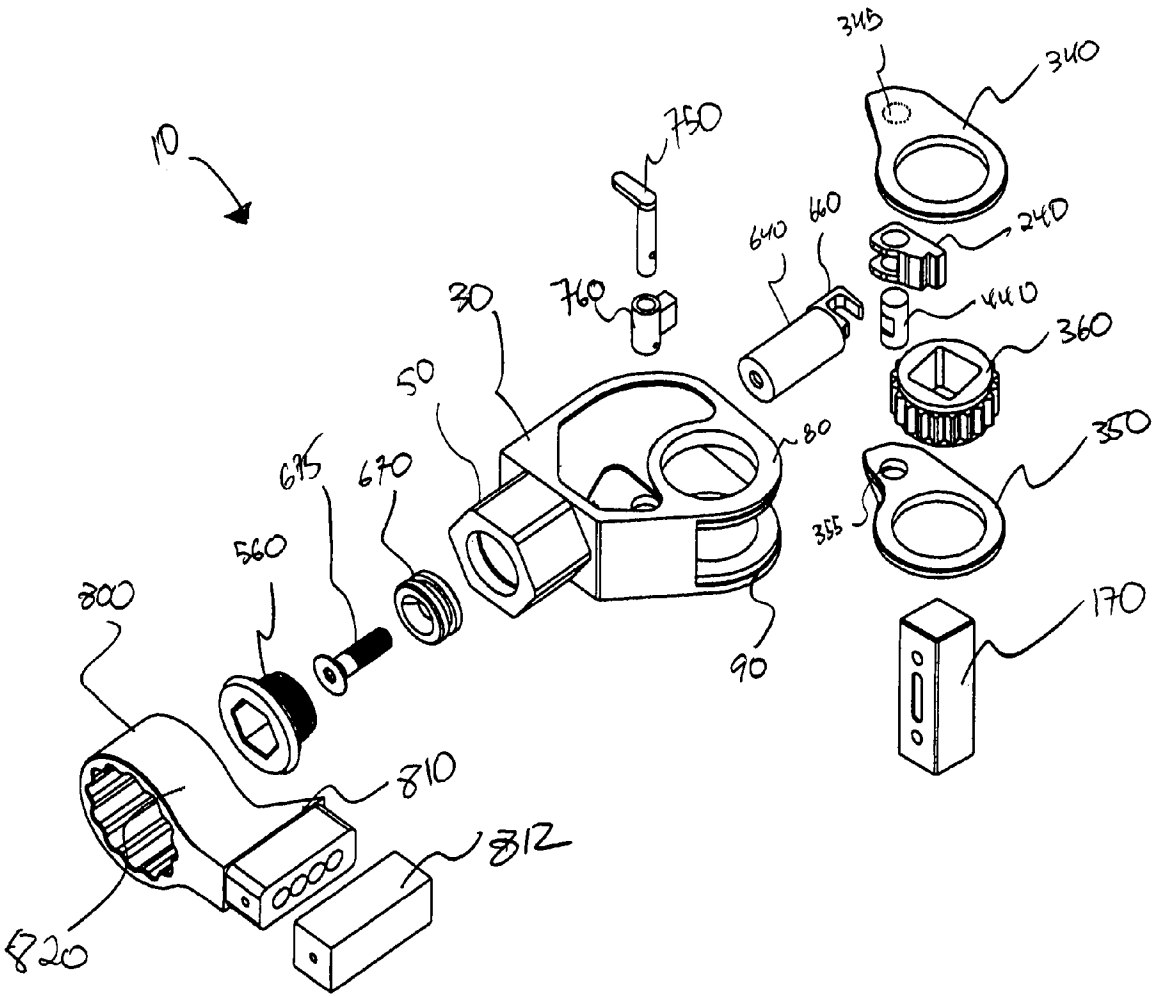
FIG. 2 is an exploded view of the embodiment shown in FIG. 1.

FIG. 2 shows an exploded view of a preferred embodiment for torque wrench 10. Torque wrench 10 can comprise body 30, body 30 including a cylinder 500 for hydraulically reciprocating a piston 640. The piston 640 being operably connected to a driver 160. The connection between the piston 640 and driver 160 can be a ratcheting mechanism comprising a drive gear 360. Torque wrench 10 can include a reaction bar 800 which provides a reacting force in opposition to the torque applied by driver 160 on threaded fastener 850. Driver 160 can be operably connected to a drive shaft 170 which can be a square shaft detachably connectable to a socket 15 (not shown in this Figure) which itself connects to threaded fastener 850. There can be further included exchangeable sockets mountable on driver 160 for engaging a head of a threaded fastener 850, such as a bolt or nut.

Cylinder 500 can be integrally formed in body 30. One end of body 30 can include piston stopper 560 which is threadably connected to body 30 to receive hydraulic cylinder 500 parts such as piston 540, and the other end body 30 has an opening 45 to receive driver 160 parts, such as drive gear 360. Piston rod 650 includes slot 700 and maintains a perpendicular force in relation to drive shaft 170 during the entire stroke of piston 640.

During operation a reaction torque (or force) equivalent to the torque applied by torque wrench 10 will be generated when removing threaded connector 850. This reaction torque must be compensated for, such as by having reaction bar 800 transmit such torque to the structure which threaded connected 850 is located. When drive shaft 170 is first operably connected to threaded connector 850 (such as through a socket head), reaction bar 800 may not be in contact with the structure. Torque wrench 10 should be rotated until reaction bar 800 contacts the structure. Otherwise body 30 of torque wrench 10 will rotate until contacting the structure possibly causing injury if hands or fingers are caught in between the structure and body 30. During the application of force to turn threaded connector 850 in a first direction, a reaction force will be generated in a second direction tending to turn body 30 in the opposite direction in which threaded connector 850 is being turned. Reaction bar 800 can be used to contact the adjacent structure and provide a reacting force so that a user is not required to manually apply the reacting force which can be as high as 50,000 foot pounds.

Figure 3:
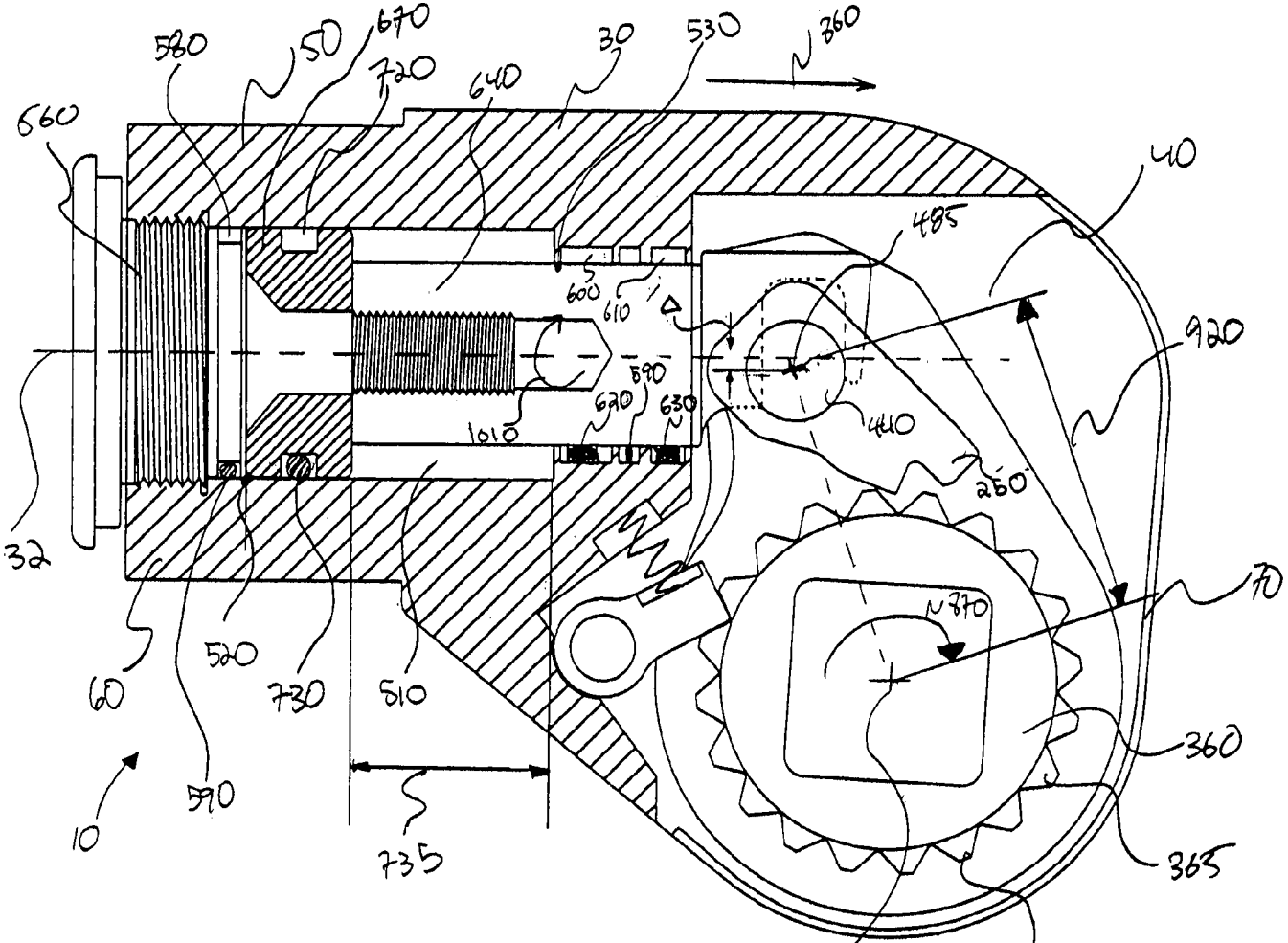
FIG. 3 is a sectional view of the embodiment shown in FIG. 1 with the piston at beginning stroke.
Figure 26:
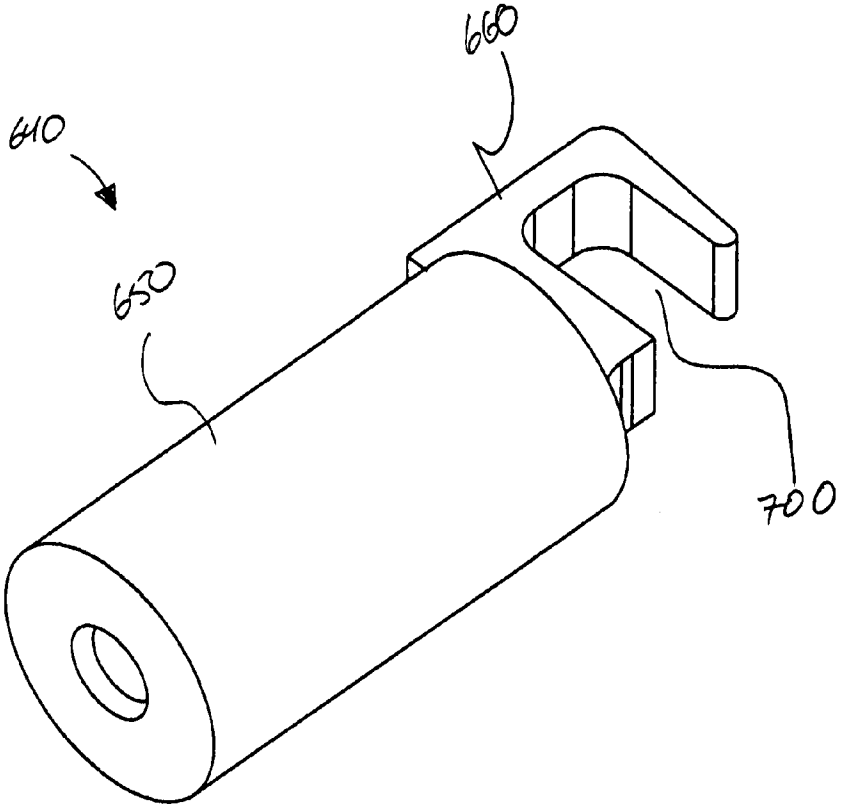
FIG. 26 is a perspective view of a piston.
Figure 27A:
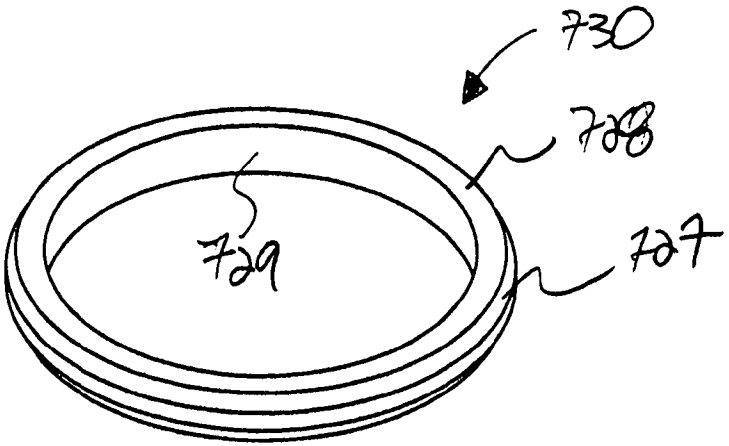
FIGS. 27A,27B,27C are respectively perspective, side, and top views of a seal.
Figure 27B:
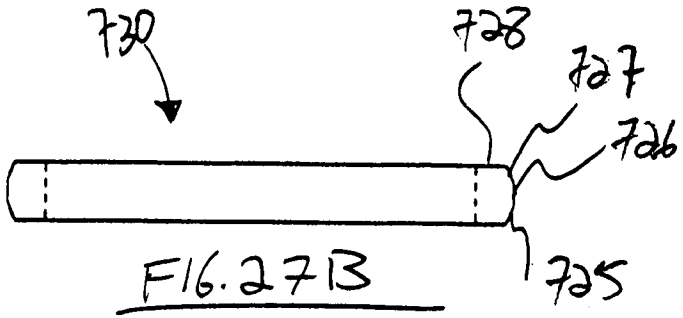
Figure 27C:
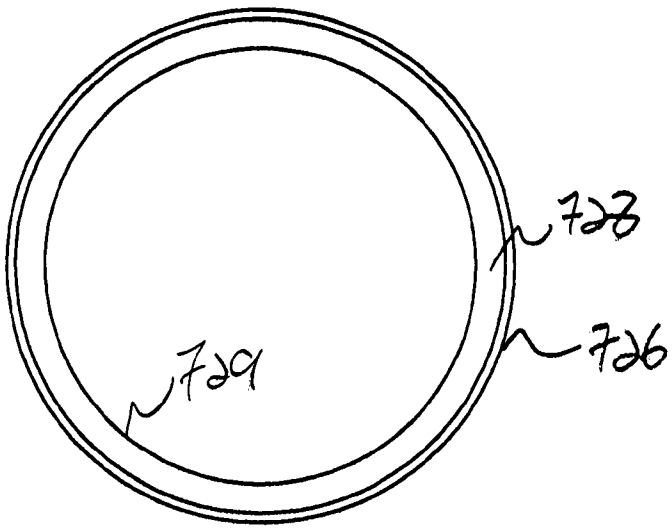

As shown in FIGS. 3 and 26 piston 640 can comprise a rod 650 having a tip 660 with the tip 660 having an elongated slot 700. On the end opposing tip 660 can be connected base 670.

Body 30 can include base section 50, interior 40, cylinder 500, and front section 70. Base section 50 can include hexagonal section 60 for incorporating reaction bar 800. Front section 70 can operate drive 160. Front section 70 can include first and second plates 70,80 which respectively can include first and second bores 100,110. Hydraulic ports 520,530 can be used for introducing hydraulic fluid into cylinder 500 during operation.

Driver 160 can comprise drive shaft 170, drive gear 360, first and second drive plates 180,190, and drive pawl 240. Drive gear 360 can be rotatably connected to first and second drive plates 180,190. Drive pawl 240 can be operably connected to drive gear 360 through a plurality of teeth 365 located on drive gear 360. Tip 250 of drive pawl can ratchet with respect to the plurality of teeth 365.

Cylinder 500 can comprise cylinder chamber 510, rear wall 540, front wall 550, piston stopper 560, and end cap 570. A reciprocating piston 640 can included in cylinder chamber 510 and can move in the direction of arrows 860,870 depending on the direction of fluid flow in cylinder chamber 510 from hydraulic ports 520,530.

Reciprocating piston 640 can comprise piston rod 650, tip 660, and base 670. Tip 660 can comprise slot 700 for operably connecting piston 640 to driver 160. Base 670 can include groove 720 for installing a seal 730 which seals base 670 to the walls of cylinder chamber 510 during operation.

Reciprocating piston 640 can be operably connected to driver 160 though a connection between drive pawl 240 and tip 660. Pin 440 can extend through bores 280,290 in first and second plates 260,270 for drive pawl 240. Tip 660 can connect to pin 440 through slot 700.

Piston rod 640 can be attached to piston rod tip 660 which is operably connected to drive pin 440 through slot 700. Drive pin 440 is operably connected to drive pawl 240 and first and second drive plates 340,350. First and second drive plates 340,350 are pivotally connected to drive pin 440 through bores 280,290 (FIG. 2). Drive pawl 240 is operatively connected to drive gear 360 by a plurality of angular gear teeth 365 and drive pawl spring 242. Drive plate extension 342 biases spring 242 against drive pawl 240 and drive pawl 240 against plurality of angular teeth 365. Drive gear 360 is connected to drive shaft 170 through opening 367. Drive gear 360 is rotatably connected to wrench body 30 through bores 100,110. Extension of piston rod 640 rotates first and second drive plates 340,350; thereby moving drive pin 440 and rotating drive pawl 240 engaging drive gear 360, and turning drive shaft 170, and finally engaging nut or bolt 850. Drive bushings 950,960 can be operatively connected to drive gear 360. Drive bushings 950, 960 can fit into 100,110 of wrench body 30 and can reduce friction and act as a bearing surface during rotation of drive shaft 170. During retraction of piston rod 640 inside hydraulic cylinder 500, piston rod 640 pulls drive pin 440, and drive plates 340,350 which, in turn pulls drive pawl 240. However, during retraction, drive pawl 240 ratchets over drive gear 340 without moving such gear.

Figure 22:
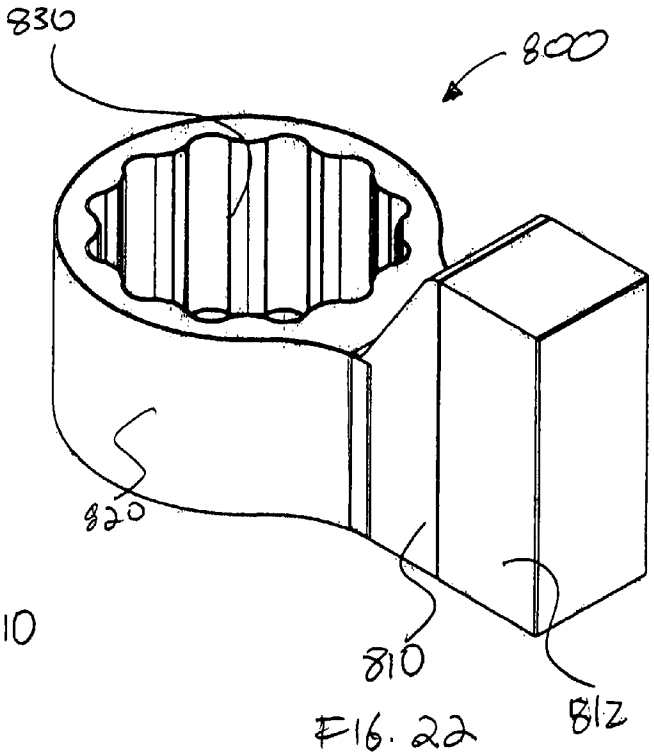
FIG. 22 is a perspective view of a reaction bar.
Figure 24:
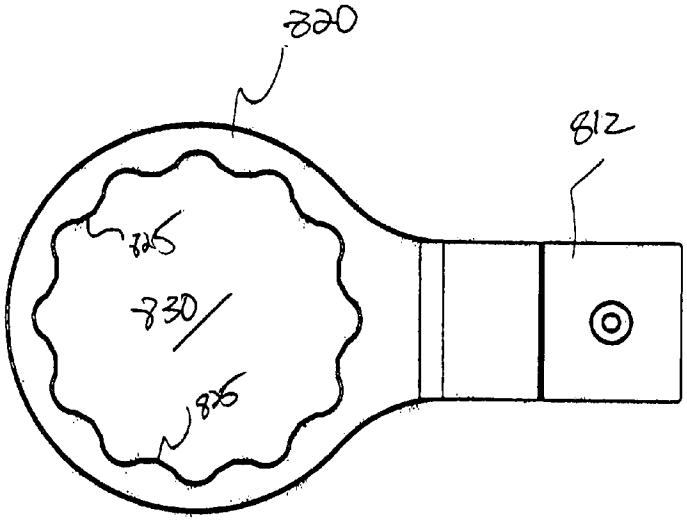
FIG. 24 is a side view of the reaction bar shown in FIG. 22.
Figure 23:
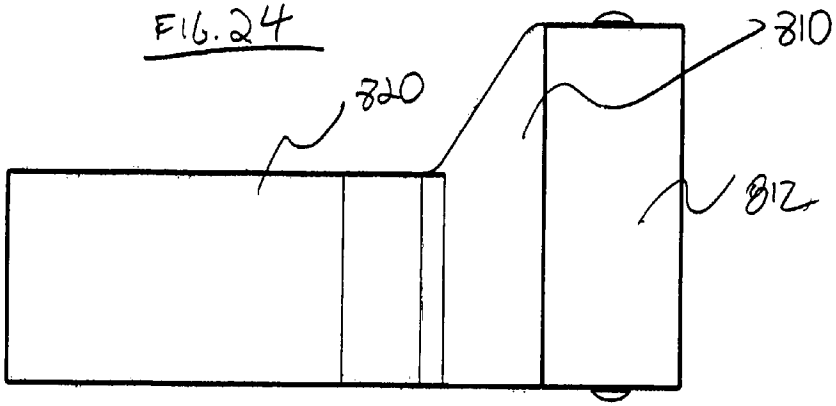
FIG. 23 is a top view of the reaction bar shown in FIG. 22.

Reaction bar 800 can be connected to wrench body 30 and will be in contact with a structural component and provide a reaction force to compensate for the torque generated by the torque wrench 10. As shown in FIGS. 22 through 24, reaction bar 800 can comprise arm 810, base 820, a plurality of splines 825, and opening 830. Plurality of splines 825 can be fitted on for engaging hexagonal section 60 of torque wrench 10. There can be included a set screw hole for fixing base 820 onto hexagonal section 60.

Figure 4:
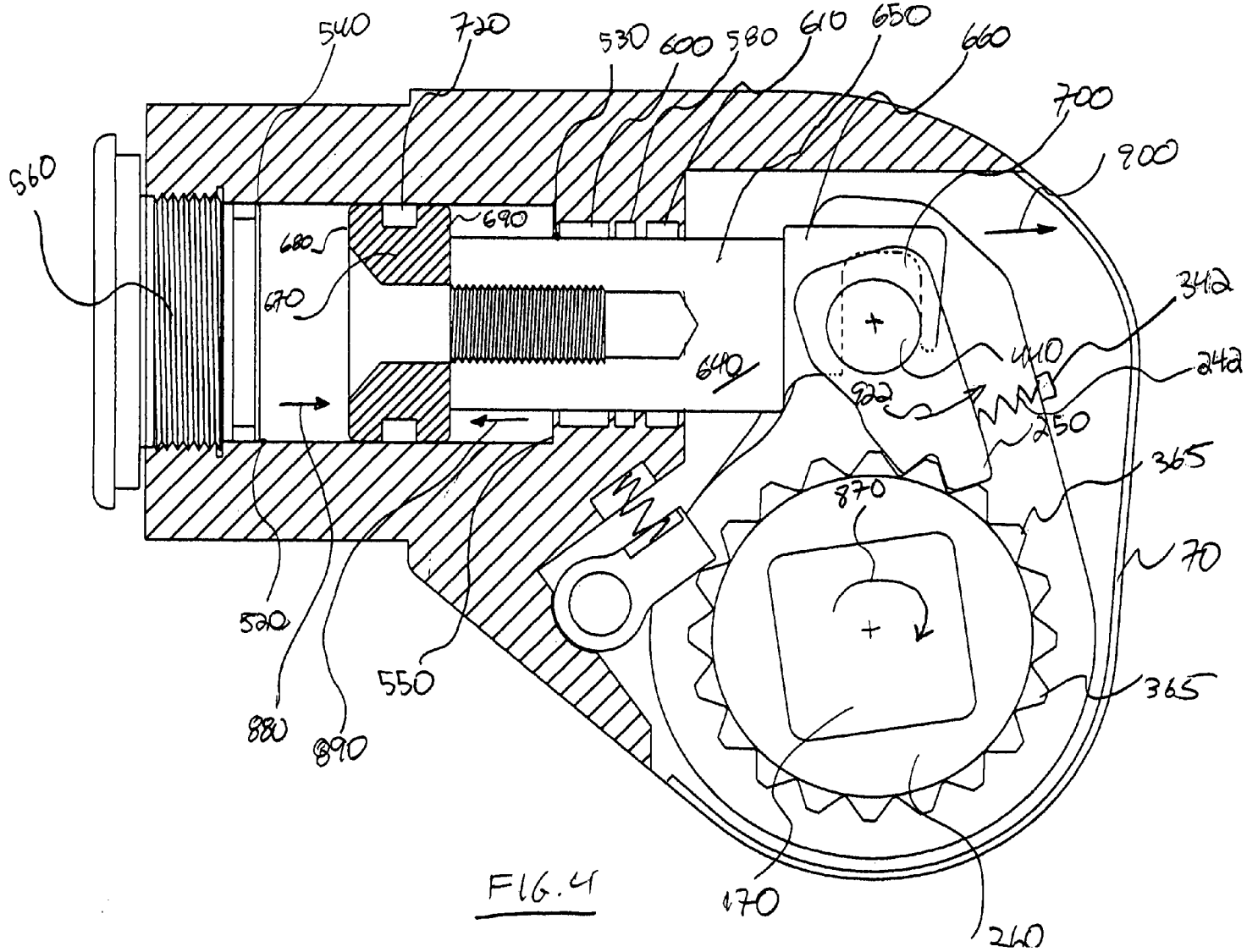
FIG. 4 is a sectional view of the embodiment shown in FIG. 1 with the piston at intermediate stroke.
Figure 5:
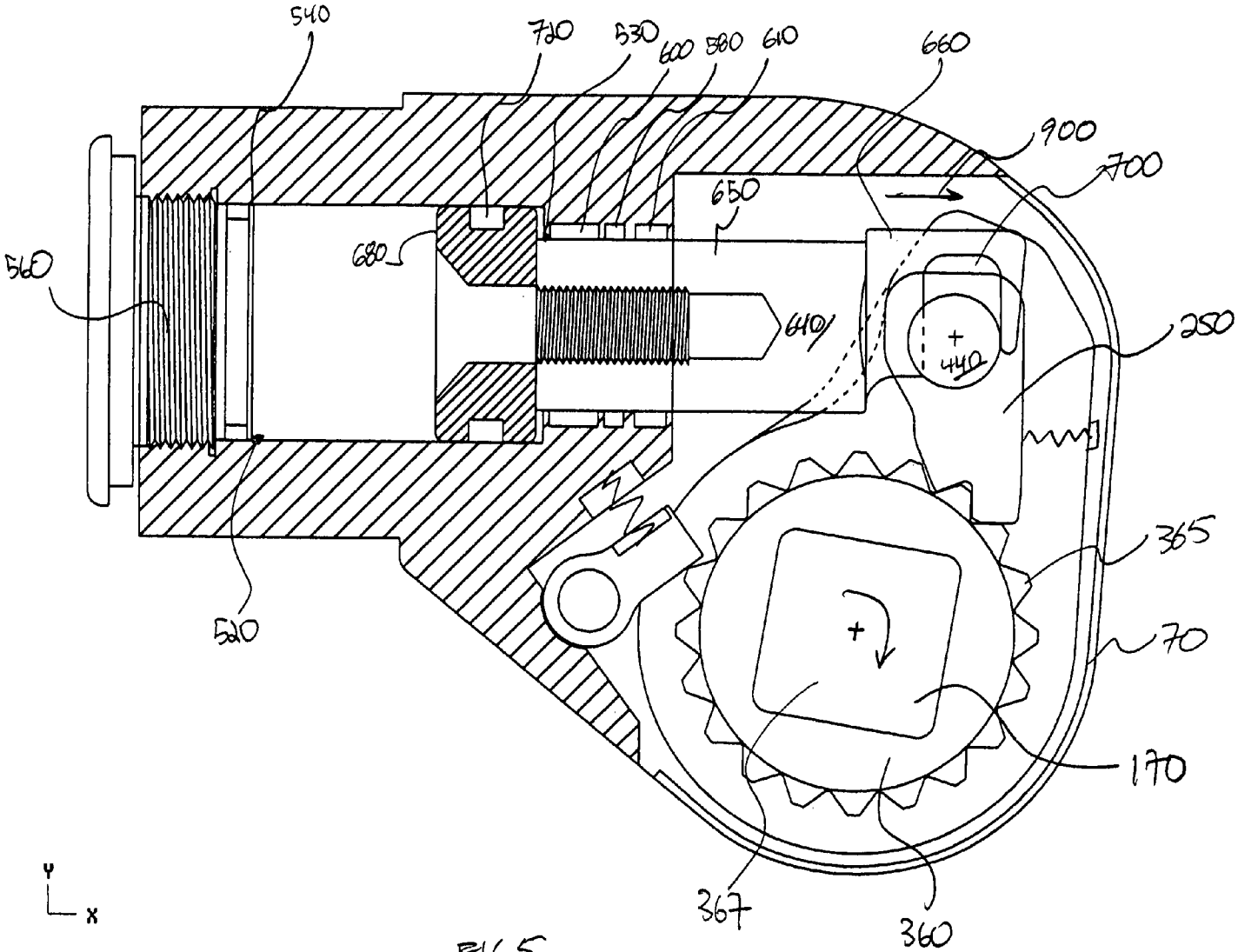
FIG. 5 is a sectional view of the embodiment shown in FIG. 1 with the piston at full stroke.
Figure 6:
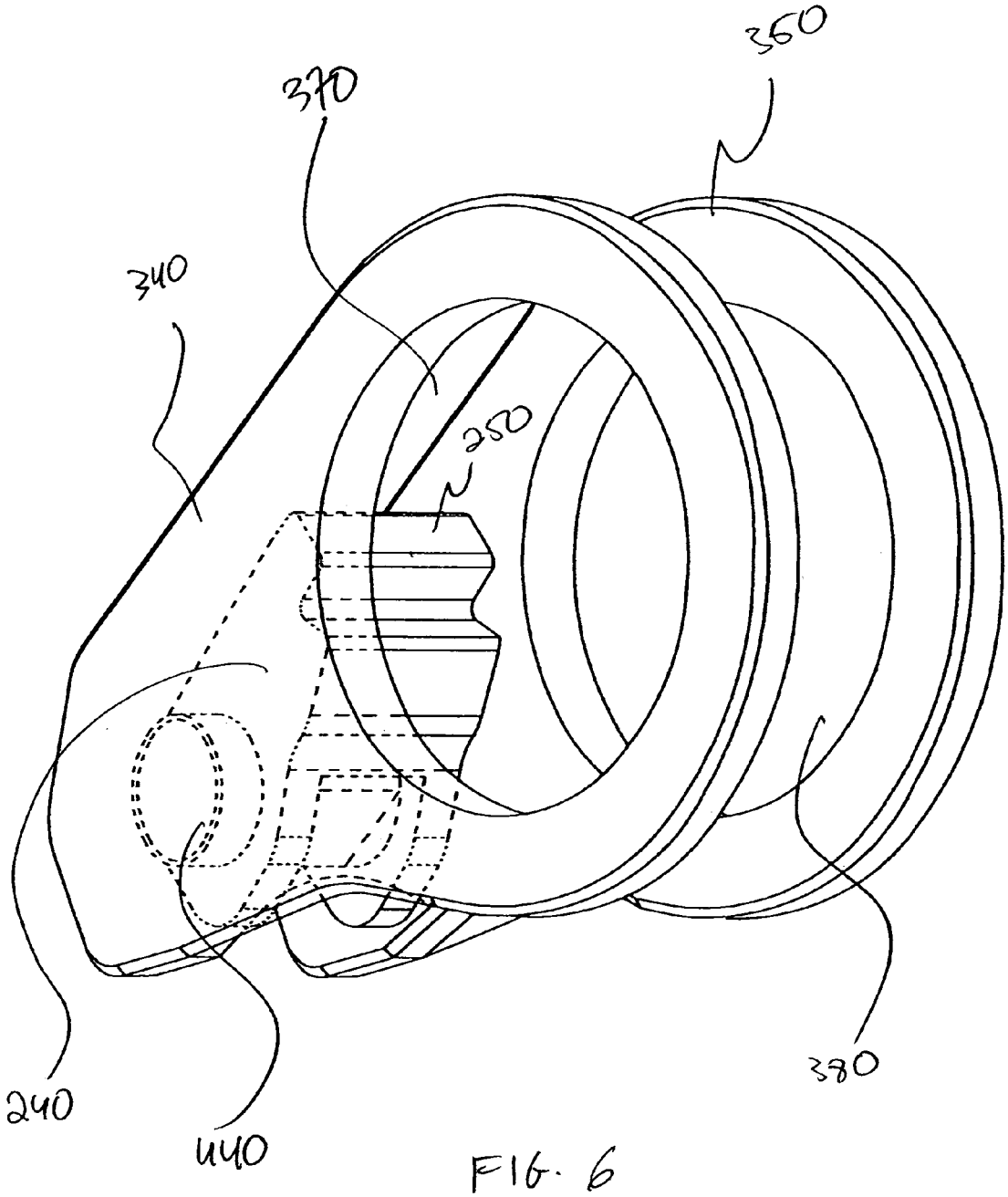
FIG. 6 is a partial perspective view of the pin, pawl, and drive plates.

FIGS. 3 through 5 schematically illustrate stroking of torque wrench 10. FIG. 3 is a sectional view of torque wrench 10 with piston 640 at beginning stroke. FIG. 4 is a sectional view torque wrench 10 with piston 640 at intermediate stroke. FIG. 5 is a sectional view of torque wrench 10 with piston 640 at full stroke. Movement of piston 640 is controlled by the flow of hydraulic fluid through ports 520,530. FIG. 4 shows piston 640 moving in the direction of arrows 890,900. For movement in this direction hydraulic fluid enters cylinder through port 520. This hydraulic fluid pushes against first area 680 of piston base 670. A pushing force is created which is equal to the pressure of the hydraulic fluid from port 520 multiplied by the size first area 680. Such force cause piston 640 to move in the direction of arrow 880. At the same time hydraulic fluid inside of cylinder chamber 510, but on the side of second area 690 will exit through port 530. As piston moves in the direction of arrow 900 pin 400 and drive pawl 250 operably engage the plurality of angular teeth 365 causing drive gear 360 to rotate in the direction of arrow 870. As additional hydraulic fluid is pumped through port 520 piston 640 will continue to move in the direction of arrows 880,900 until second face 690 contacts front wall 550 (or piston stopper 560). At this point drive gear 360 has seen the maximum rotation in the direction of arrow 870 for this piston stroke. Now piston 690 can be returned to its beginning stroke position.

To return piston 690 to the beginning stroke position hydraulic fluid is pumped into port 530 and pushes against second area 690 of piston base 670. A pushing force is created which is equal to the pressure of the hydraulic fluid from port 520 multiplied by the size second area 690. Such force will cause piston 640 to move in the direction of arrow 890. At the same time hydraulic fluid inside of cylinder chamber 510, but on the side of first area 680 will exit through port 520. As piston moves in the direction of arrow 890, drive pawl 250 will slip over the plurality of angular teeth 365 by rotating in the direction of arrow 920. Drive gear 360 will be prevented from rotating in a direction opposite arrow 870 by arm 820 operably engaging plurality of angular teeth 365. As additional hydraulic fluid is pumped through port 530 piston 640 will continue to move in the direction of arrows 890 until first face 680 comes to the initial stroke position. At this point piston 690 is ready for a second stroke.

The above movement can be described as a ratcheting movement. To reverse rotation of drive shaft 170, torque wrench 10 must be removed from nut or bolt 850, body 30 turned over and again fastened to nut or bolt 850. Drive shaft 170 is slidably connected to drive gear 360 to allow shaft 170 to protrude from the side of body 30 on which nut or bolt 850 is to be tightened or loosened. One side of body 30 drive shaft 170 will rotate clockwise and the other side of body 30 will rotate counterclockwise.

Fluid flows enters the rear of cylinder chamber 510 (through hydraulic port 520) causing piston 640, piston rod 650, and tip 660 to extend. Piston 640 is driven forward by the fluid pressure, and piston rod tip 660 engages driver 160 to impart high-torque rotation to threaded fastener 850. Fluid exits cylinder chamber 510 through hydraulic port 530 returning to hydraulic fluid source 20. Once piston 640 extends fully forward, the fluid flow is manually switched. Fluid now enters cylinder chamber 510 through hydraulic port 530 and exits through port 520 moving piston 640 toward rear wall 540. The fluid between piston 640 and rear wall 54 is forced out through port 520 and returning to fluid source 20. Once piston 640 retracts fully inward, fluid flow is again manually switched back to the flow directions for forward movement. This process is repeated until threaded fastener 850 has been completely tightened to the required high torque, and torque wrench 10 can be applied to another threaded fastener.

Should one wish to loosen a torqued threaded fastener, such as nut or bolt 850, torque wrench 10 is simply "flipped over" and the opposite end of drive shaft 170 is operably connected to threaded fastener 850. Flipping over wrench 10 will cause drive shaft 170 to rotate in a counter-clockwise direction thereby loosening threaded fastener 850. As described above hydraulic fluid is manually controlled to extend and retract piston 640. Retraction of piston 640 as described above is accomplished by manually switching the direction of fluid flow into and out of hydraulic ports 520,530 from hydraulic fluid source 20. Also as described above the direction of fluid flow into and out of hydraulic ports 520,530 from hydraulic fluid source 20 is manually switched to cause piston 640 to extend.

The wrench can also include a neutral release lever wherein a neutral position the wrench would free wheel with the lever release disengaged drive pawl of the drive mechanism and the lever release is positioned between the drive mechanism and the reciprocating power source. The neutral release lever may be fixed or attachable. The lever extends to a position in which on total reaction, the drive pawl is disengaged.

Figure 25:
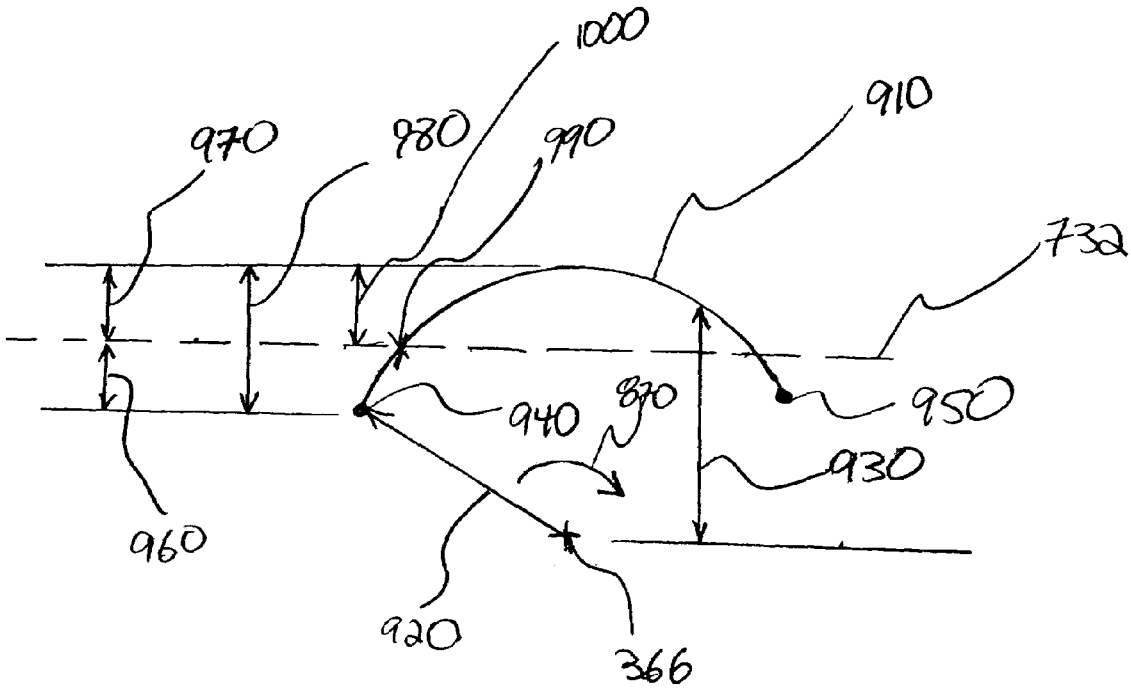
FIG. 25 is a drawing illustrating movement of the drive pin about the center line of the piston.

FIG. 25 graphically illustrates the changes in torque during a full stroke of piston 640. During each stroke piston 640 travels along a straight line which is indicated by center line 732 through the longitudinal center of piston 640. However, drive pin 440 moves through an arc 910, which arc forms part of a circle having a radius equal to the distance between center of drive gear 360 (and also center of bore 370 of first drive plate 340) and the center 485 of drive pin 440 (and also the center of recessed are 345 of first drive plate 340). That is, first drive plate 340 controls the radial position of drive pin 440 as pin 440 moves about drive gear 360. Dimensional line 930 graphically represents the vertical distance between the center 485 of drive pin 440 and the center 366 of drive gear 360. The torque applied to drive gear 360 at any given instant is equal to the hydraulic force applied on piston 640 multiplied times the vertical distance 930. The hydraulic force applied to piston 640 can remain constant during strokes of piston 640. However, because torque equals force times length, the torque applied to drive gear 360 will vary according to the variance of the vertical distance 930. In embodiment, piston 640 is positioned where its centerline 732 falls in the middle 990 of the vertical movement of drive pin 440. When located in middle 990 the deviation in torque applied to drive gear 360 during a given stroke of piston 640 will be minimized because the deviation in vertical distance 930 will be minimized. Prior art torque wrenches line up center line 732 of piston 640 with position 940. In these prior art wrenches the deviation in vertical distance 930 will be equal to vertical travel 980. With the instant embodiment the deviation in vertical distance 930 will be one half of vertical travel 980 as distance 960 will be equal to distance 970. Such a construction will minimize variances in torque during any given stroke. Another method of minimizing deviations of torque is to vary hydraulic pressure on piston 640 in relation to the vertical distance 930. That is, as vertical distance 930 increases during a stroke, hydraulic pressure can be reduced to maintain a constant torque. Further, when vertical distance 930 decreases during a stroke, hydraulic pressure can be increased to maintain a constant torque. The change in pressure can be calculated based on the change in vertical distance 930. However, with this embodiment the position of piston 640 (or angular position of drive plate 340) would probably have to be known to calculate the change in vertical distance 930.

The other problem addressed by centering centerline 732 in the middle of arc 910 is reducing any reverse torque on piston 640. Whenever center 445 of drive pin 440 moves away from centerline 732 of piston 640 a reverse torque will be applied to piston 640 equal to the vertical distance 1000 multiplied by the hydraulic force on piston 640. This reverse torque tends to rotate piston 640 in relation to cylinder 500 and this tendency to rotate can cause premature seal failure along with wear between piston 640 and cylinder 500. Placing centerline 732 of piston 640 in the middle of arc 910 will minimize vertical distance 1000 and therefore minimize the amount of reverse torque for any given hydraulic force. The delta in FIG. 3 schematically illustrates the vertical distance 1000. Arrow 1010 shows the reverse torque being applied to piston 640. In other embodiments centerline 732 is placed between about 0 and 50 percent from the centerline to maximum vertical movement of drive pin 440; more preferably between about 0 and 35 percent; more preferably between about 0 and 25 percent; and most preferably between about 0 and 10 percent.

In one embodiment hydraulic cylinder 500 can include spaced apart wear rings 620, 630 respectively located in grooves 600,610. Wear rings 620,630 can be used to prevent wear between piston 640 and hydraulic cylinder 500, such as the walls of chamber 510. During the stroke piston 640 can contact wear rings 620,630 and not the walls of chamber 510. Accordingly, the walls of chamber 510 will not scratch or scar the surface of piston 640. Additionally, piston 640 will not scratch or scar the walls of chamber 510. Spacing apart wear rings 620,630 also helps the rings absorb the reverse torque discussed above. The reverse torque discussed above can be absorbed by seal 730 (and piston base 670), along with wear rings 620,630.

It has been found that a v-cut shape for seal 730 provides a longer seal life. Seal 590 for end cap 560 can also be a v-cut.

Figure 7:
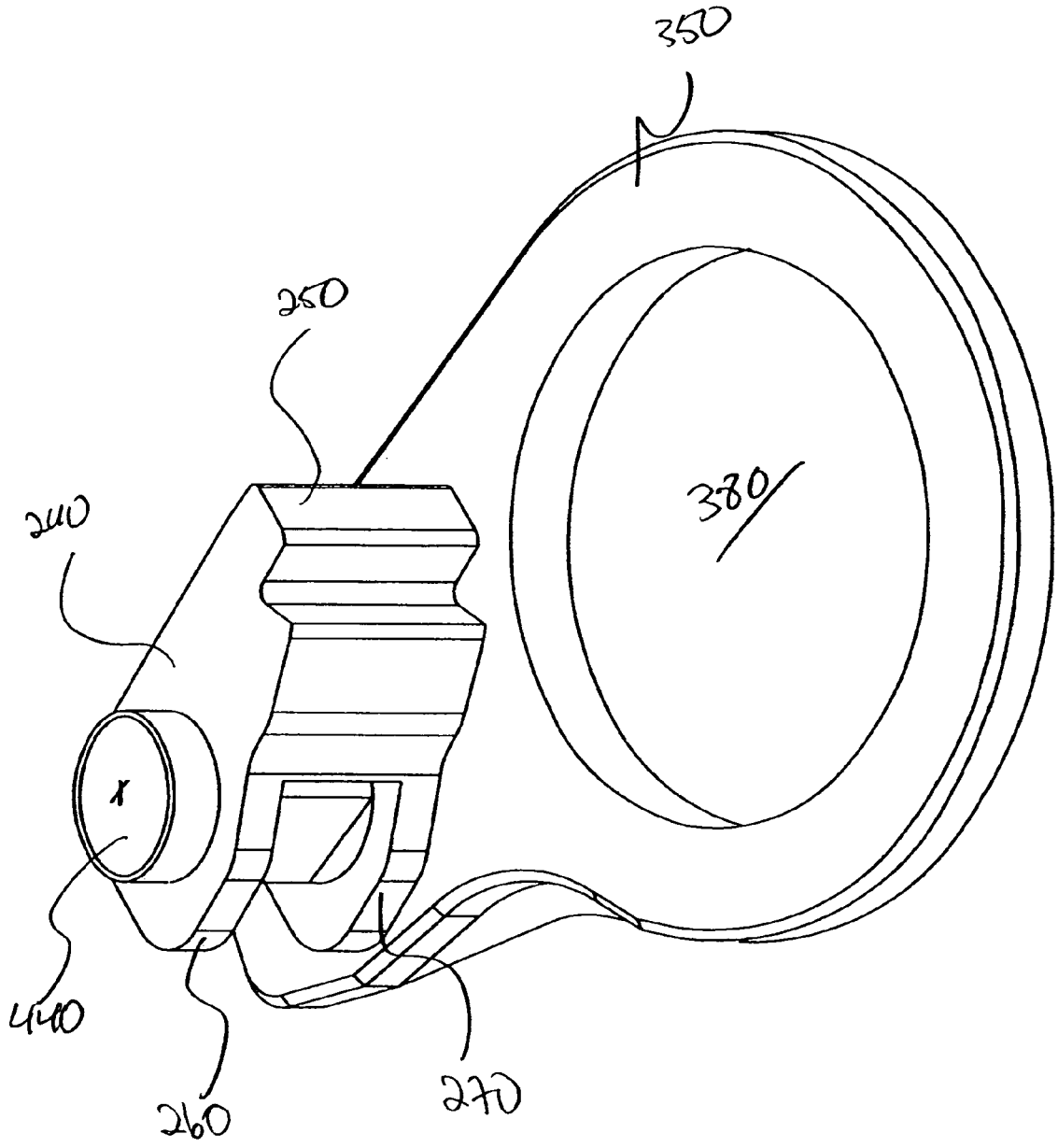
FIG. 7 is a partial perspective view of the pin, pawl, and a single drive plate.
Figure 8:
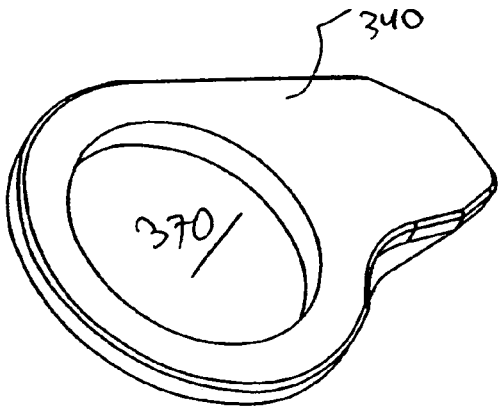
FIG. 8 is a perspective view of a drive plate shown from the top.
Figure 9:
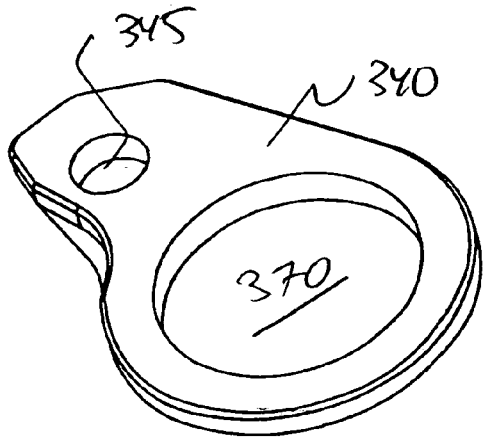
FIG. 9 is a perspective view of the drive plate of FIG. 8 shown from the bottom.
Figure 10:
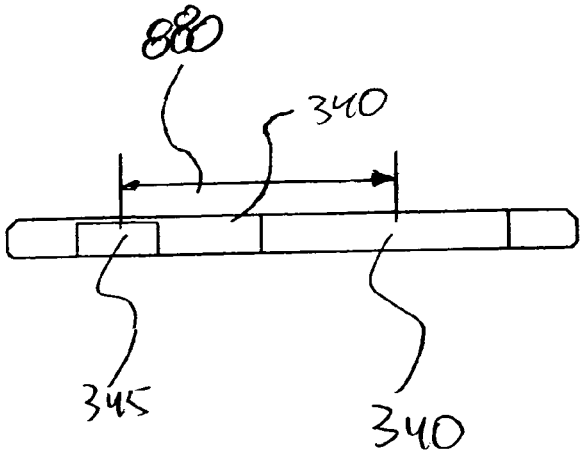
FIG. 10 is a side view of the drive plate shown in FIG. 8.
Figure 11:
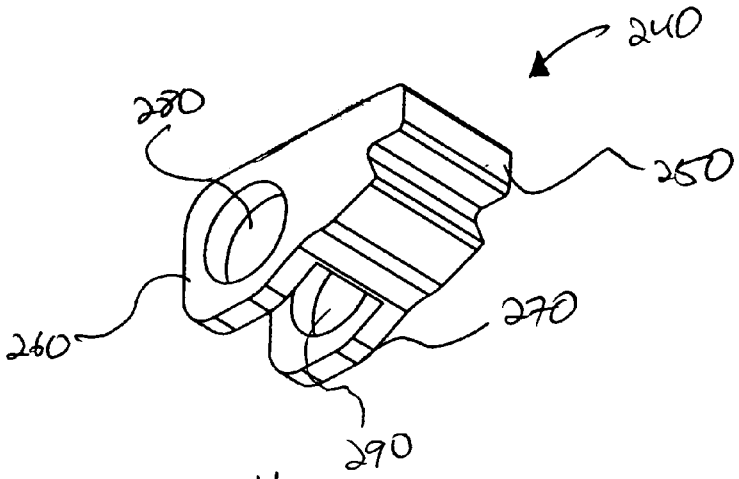
FIG. 11 is a perspective view of a pawl.
Figure 12:
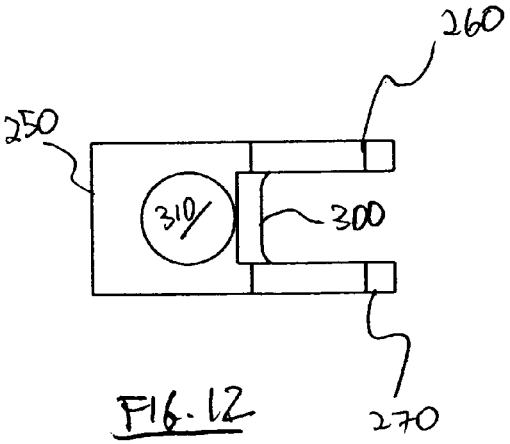
FIG. 12 is a top view of the pawl shown in FIG. 11.
Figure 13:
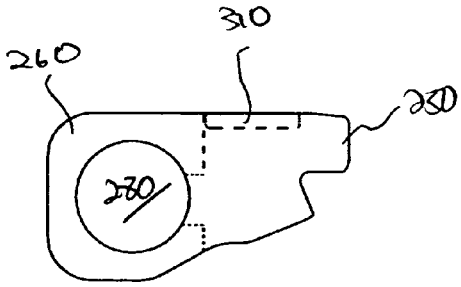
FIG. 13 is a side view of the pawl shown in FIG. 11.
Figure 14:
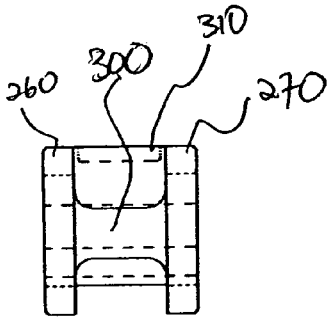
FIG. 14 is a rear view of the pawl shown in FIG. 11
Figure 15:
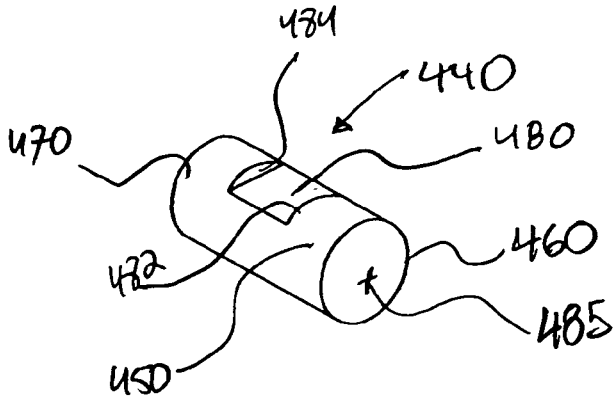
FIG. 15 is a perspective view of a pin.
Figure 16:
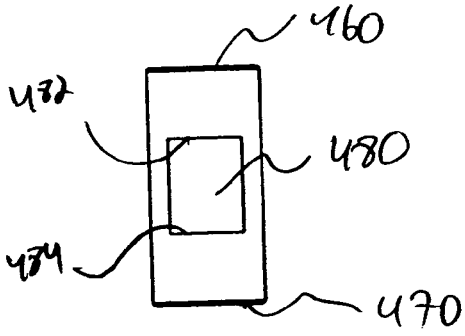
FIG. 16 is a top view of the pin shown in FIG. 15.
Figure 17:
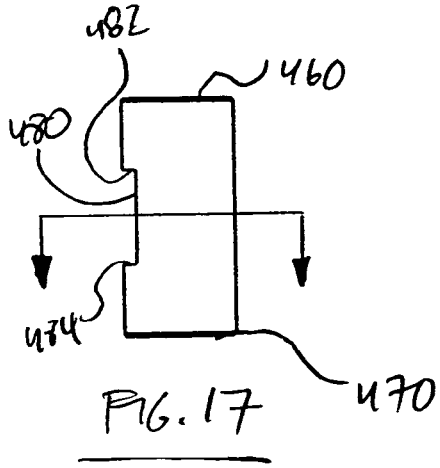
FIG. 17 is a side view of the pin shown in FIG. 15.
Figure 18:
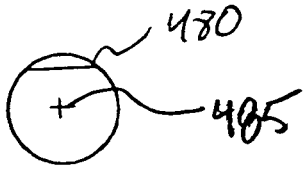
FIG. 18 is a rear sectional view of the pin shown in FIG. 15, but taken along the lines 18—18 of FIG. 17.
Figure 20:
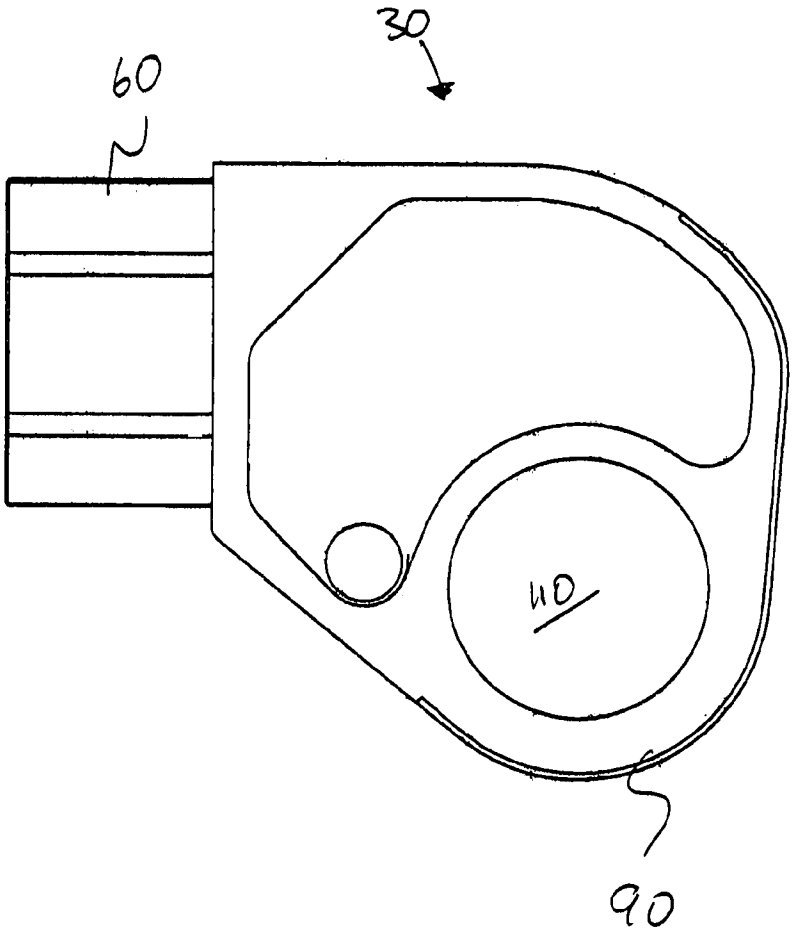
FIG. 20 is a left side view of the body of the wrench shown in FIG. 1.
Figure 19:
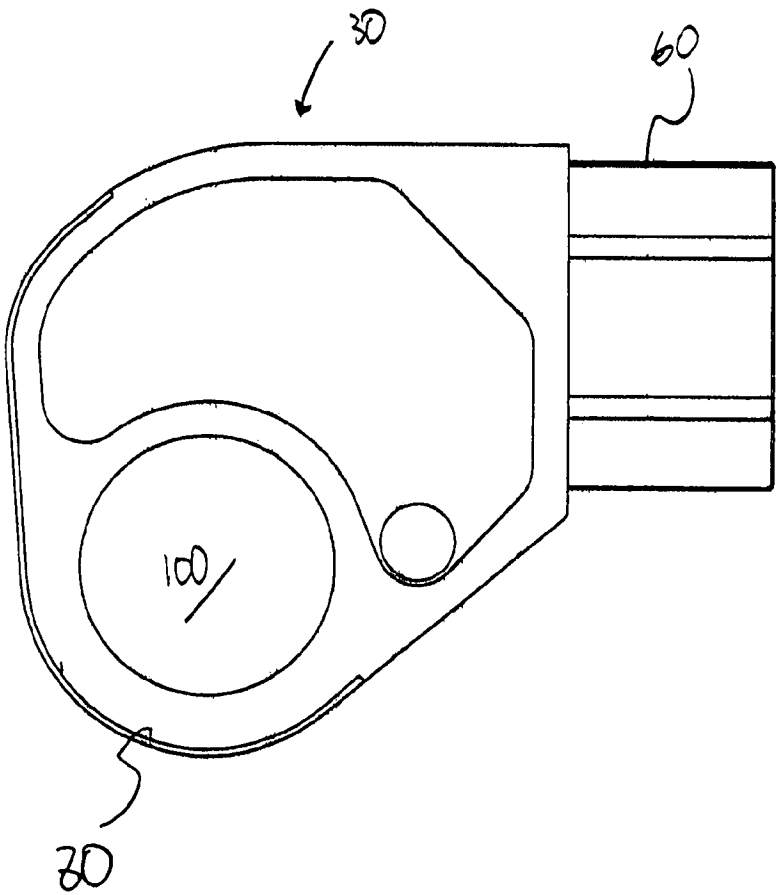
FIG. 19 is a right side view of the body of the wrench shown in FIG. 1.
Figure 21:
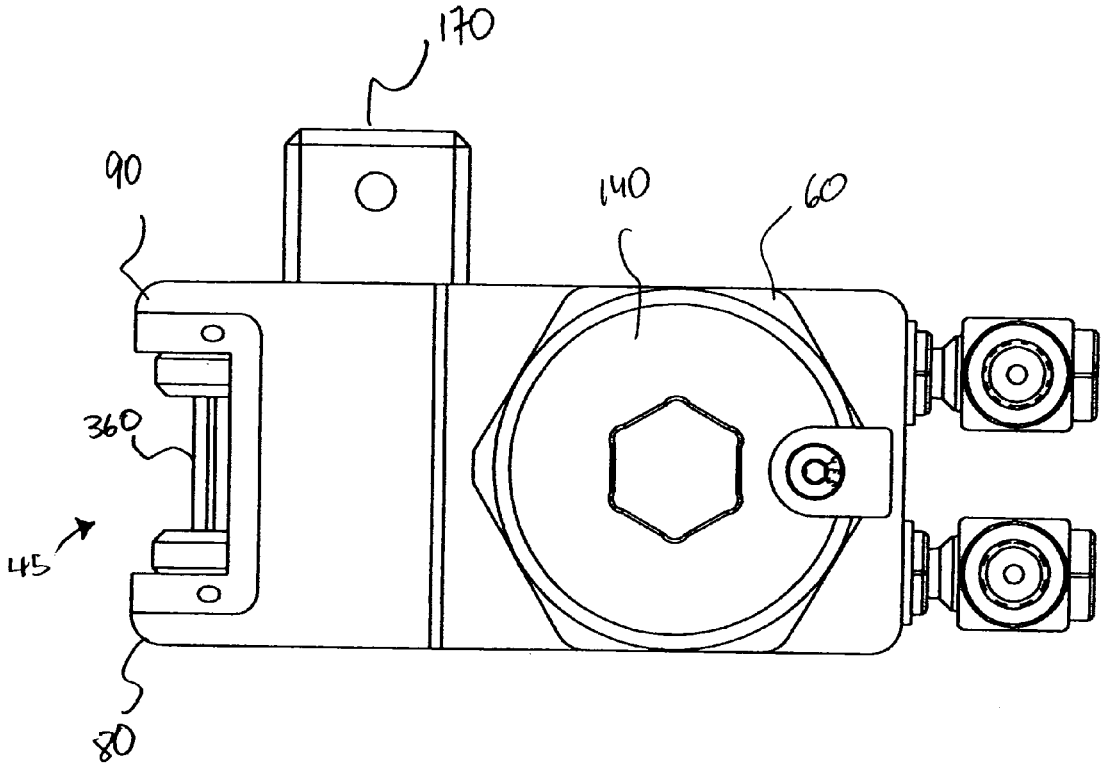
FIG. 21 is a rear view of the wrench shown in FIG. 1.

FIGS. 11 through 14 show a preferred drive pawl 240. Drive pawl 240 can include support area 300. FIG. 11 is a perspective view of drive pawl 240. FIG. 12 is a top view of drive pawl 240. FIG. 13 is a side view of drive pawl 240. FIG. 14 is a rear view of drive pawl 240. FIG. 7 is a perspective view showing drive pin 440 mounted in drive pawl 240 and also mounted in second drive plate 350. One of the problems with prior art torque wrenches is bending or failure of drive pin 440. Typically, drive pin 440 is supported by first and second plates 260,270. However, with large forces drive pin 440 can deflect/bend between plates 260, 270 causing fatigue and other problems. In one embodiment drive pawl 240 can include support area 300. Support area 300 can provide intermediate support (between plates 260, 270) to drive pin 440 and resist bending of drive pin 440. Support area 300 can extend from plate 260 to plate 270. In an alternative embodiment support area does extend from plate 260 to plate 270. In another alternative embodiment support area 300 comprises a support post. In another embodiment support area 300 substantially follows the curvature of drive pin 440.

It has been found that in prior art wrenches the sides of the drive pin touch the interior of the wrench body during motion. This can cause wear, scratching, gouging, and premature failure of bodies along with drive pins. During torque wrench operation drive pins can shift to one side until contacting the interior of the wrench bodies. Because of the large forces placed on drive pins during operation the drive pins will tend to flex and their sides extending outward even further. As the drive pins are moved through an arc around the drive gears, the side of the drive pin contacting the interior of the drive body can wear, gouge, scratch, scar, or otherwise impair the interior of the drive body. This mechanism can continue (as the drive pin can move over even more where a groove appears in the wall of the body) until the drive body needs repair or replacement. In one embodiment first and second ends 460,470 of drive pin 440 are restricted from touching the interior 40 of body 30. In one embodiment first and second plates 340,350 can respectively include recessed areas 345,355, instead of bores therethrough. Recessed areas 345,355 will prevent either first or second end 460,470 from contacting interior 40 of body 30 and wearing interior 40 of body 30. In another embodiment first and second ends 460,470 of drive pin 440 have their movement restricted past first and second drive plates 340, 350. Instead of recessed areas 345,355, bars/restrictors can be placed in bores which replaced recessed areas 345,355. In another embodiment, a wear plate can be placed on interior 40 of body 30—which wear plate tracks the movement of drive pin 440. In another embodiment interior 40 of body 30 can be coated with a material to resist wear from first and second ends 460,470 of drive pin 440. In another embodiment the hardness of interior 40 of body 30 can be made harder than the hardness of drive pin 440. Because drive pin 440 is softer in this embodiment, drive pin 440 will wear instead of interior 40 of body 30.

In another embodiment drive pin 440 and drive plates 340,350 can be configured to resist side to side movement of drive pin 440. This can be accomplished by a variety of means, such as by beveling first and second ends 460,470 of drive pin 440 to mate with openings in first and second drive plates 340,350. In another embodiment the center 445 of drive pin 440 can have a larger cross section than the first and second ends 460,470. The larger drive pin 440 cross section in the center 445 would resist movement of drive pin 440 from side to side beyond first and second drive plates 340,350 and resist contact by drive pin 440 with body 30. In another embodiment a restriction can be placed on drive pin 440 to restrict side to side movement of drive pin 440 past drive plates 340,350. Such a restriction could include a projection from drive pin 440 on either or both sides of drive pin 440. The projections can include one or more annular rings, set screws, rods, spikes, arms, or other projections. In another embodiment drive plates 340,350 can be mechanically linked with drive pin 440 to prevent side to side or lateral movement of drive pin 440. Such mechanical linkage can include set screws, snap rings, or other linkages. For example, snap rings can be placed on either side of drive pin 440, but on the inside of drive plates 340,350 and these snap rings would resist side to side movement of drive pin 440. As another example, set screws could be used between drive plates 340,350 and first and second ends 460,470 of drive pin 440 mechanically connecting the plates to the drive pin. However, this use of set screws is not preferred because it would resist relative rotation of drive pin 440 and drive plates 340,350. In another embodiment drive pin 440 can be fastened to drive plates 340,350 by welding or an adhesive.

Recessed area of pin 440 can be used to reduce localized contact stresses in drive pin 440. Prior art wrenches include pins of uniform circular cross sections. In prior art wrenches it has been found that piston rod tips contact drive pins in only small localized areas and generate high localized areas of stress and deformation. In a preferred embodiment of wrench 10, drive pin 440 includes recessed area 480 which is flat and increases the area of contact to reduce/minimize localized areas of high stress. Edges 482,484 are shown at 90 degrees relative to flat area 480. However, to reduce stress concentration, edges 482,483 can be at 45 degrees or lower or can even be curved, such as parabolic or elliptical curves.

LIST OF REFERENCE NUMERALS:
The following is a list of reference numerals used in this application:

| Reference No. | Description |
|---|---|
| 10 | Torque Wrench |
| 15 | Socket |
| 20 | Hydraulic Fluid Source |
| 22 | Controller |
| 23 | Switch |
| 24 | Arrow |
| 25 | Arrow |
| 26 | Switch |
| 27 | Line |
| 28 | Line |
| 30 | Body |
| 40 | Interior of Body |
| 45 | Opening |
| 50 | Base |
| 60 | Hexagon Section |
| 70 | Front Section |
| 80 | First Plate |
| 90 | Second Plate |
| 100 | Bore in First Plate |
| 110 | Bore in Second Plate |
| 130 | Threaded Section |
| 140 | End Cap |

-continued

LIST OF REFERENCE NUMERALS:
The following is a list of reference numerals used in this application:

| Reference No. | Description |
|---|---|
| 150 | Threads |
| 160 | Driver |
| 170 | Drive Shaft |
| 180 | First Drive Plate |
| 190 | Second Drive Plate |
| 200 | Bore In First Drive Plate For Piston Rod Tip |
| 210 | Bore In Second Drive Plate For Piston Rod Tip |
| 220 | Cover for bore |
| 230 | Cover for bore |
| 240 | Drive Pawl |
| 242 | Spring |
| 250 | Tip for Drive Pawl |
| 260 | First Plate for Drive Pawl |
| 270 | Second Plate for Drive Pawl |
| 280 | Bore In First Drive Plate For Drive Pawl |
| 290 | Bore In Second Drive Plate For Drive Pawl |
| 300 | Support Area for Drive Pawl |
| 310 | Recessed Area for Drive Pawl Spring |
| 320 | Drive Pawl Spring |
| 330 | Drive Plate Spacer |
| 340 | First Drive Plate |
| 342 | Catch for Spring |
| 345 | Recessed Area of first drive plate |
| 350 | Second Drive Plate |
| 355 | Recessed Area of second drive plate |
| 360 | Drive Gear |
| 365 | Plurality of Angular teeth |
| 366 | Center of Drive Gear |
| 367 | Opening |
| 370 | Bore In First Drive Plate For Drive Gear |
| 380 | Bore In Second Drive Plate For Drive Gear |
| 390 | Bore In Drive Gear For Drive Pin |
| 410 | Drive Bushings |
| 420 | Bores In Drive Bushings For Drive Pin |
| 430 | Drive Bearings |
| 440 | Drive Pin |
| 445 | Center |
| 450 | Cylindrical Section |
| 460 | First End of Drive Pin |
| 470 | Second End of Drive Pin |
| 480 | Flat Area of Drive Pin |
| 482 | Edge |
| 484 | Edge |
| 485 | Center of Drive Pin |
| 490 | Bore In Wrench Body |
| 500 | Hydraulic Cylinder |
| 510 | Cylinder Chamber |
| 520 | hydraulic port |
| 530 | hydraulic port |
| 540 | Rear Wall Of Cylinder Chamber |
| 550 | Front Wall of Cylinder Chamber |
| 560 | Piston Stopper |
| 570 | End Cap to cylinder chamber |
| 580 | seal groove |
| 590 | seal |
| 600 | Wear Ring Groove |
| 610 | Wear Ring Goove |
| 620 | Wear Ring |
| 630 | Wear Ring |
| 640 | Piston |
| 650 | Piston Rod |
| 660 | Piston Rod Tip |
| 670 | Piston Rod Base |
| 675 | Bolt |
| 680 | First Area for Base |
| 690 | Second Area for Base |
| 700 | Slot in Tip |
| 710 | Flattened Area of Slot |
| 720 | Seal groove |
| 725 | Lower edge |
| 726 | Outer edge |
| 727 | Upper edge |
| 728 | Top |
| 729 | Interior |

-continued

LIST OF REFERENCE NUMERALS:
The following is a list of reference numerals used in this application:

| Reference No. | Description |
|---|---|
| 730 | Seal |
| 732 | Center Line for Piston Rod |
| 735 | Stroke |
| 740 | Anti-reverse mechanism |
| 750 | Lever for anti-reverse mechanism |
| 760 | Shaft |
| 770 | Lock for anti-reverse mechanism |
| 780 | Spring |
| 790 | Bearing |
| 800 | Reaction Bar |
| 810 | Arm |
| 812 | Boot for arm |
| 820 | Base |
| 825 | Spline |
| 830 | Opening |
| 840 | Prong |
| 850 | Threaded Fastener such as nut or bolt |
| 852 | Threaded Fastener such as nut or bolt |
| 860 | Arrow |
| 870 | Arrow |
| 880 | Arrow |
| 890 | Arrow |
| 900 | Arrow |
| 910 | Arc for Center Line of Drive Pin |
| 920 | Distance from Center of Drive Gear to Center of Drive Pin |
| 922 | Arrow |
| 930 | Vertical Distance from Center of Drive Gear to Center of Drive Pin |
| 940 | Position at Beginning of Stroke |
| 950 | Position at End of Stroke |
| 960 | Distance from Center of Piston to Center of Drive Pin |
| 970 | Distance from Center of Piston to Center of Drive Pin |
| 980 | Maximum Vertical Travel of Drive Pin |
| 990 | Middle |
| 1000 | Vertical distance |
| 1010 | Arrow |

Below are listed the preferred materials for various items of wrench 10. Body 30, reaction bar 800, piston rod base 670, piston stopper 560, and lever 750 can be comprised of aluminum 7075 T6. Drive pawl 240 can be comprised of 4340 carbon steel having a rockwell hardness of between 42–44. Drive gear 360 can be comprised of 4340 carbon steel having a rockwell hardness of between 42–44. Drive pin 440 can be comprised of 4340 carbon steel having a rockwell hardness of between 50–52. Piston rod 640 can be comprised of 4340 carbon steel having a rockwell hardness of between 55–57. Drive shaft 170 can be comprised of 4340 carbon steel having a rockwell hardness of between 50–52. Drive plates 260,270 can be comprised of AR400 steel having a rockwell hardness of between 44–45. Reaction boot 812 can be comprised of 4140 stainless steel having a rockwell hardness of between 42–44.

Seals 590, 730 can be Neoprene having a hardness of V90. Wear rings 620,630 can be molygard.

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The foregoing embodiments are presented by way of example only; the scope of the present invention is to be limited only by the following claims.

The invention claimed is:

1. A hydraulic wrench apparatus, comprising:

a) a housing having a first end accommodating a drive portion, and a second end defining a cylinder portion;

b) the first end having first and second opposing walls;

c) a drive portion being accommodated in the first end and between the first and second walls, the drive portion including a drive pin having first and second ends;

d) a reciprocating piston shaft housed within the cylinder portion, the piston including a tip, the tip being operably connected to the drive pin;

e) wherein movement of the drive pin is restricted so that its first and second ends do not contact the first and second walls of the housing.

2. The wrench of claim 1, wherein the drive portion includes first and second drive plates, which are spaced apart, and respectively include first and second recessed areas, the first and second ends of the drive pin being contained within the first and second recessed areas.

3. The wrench of claim 2, wherein the first and second recessed areas are circular.

4. The wrench of claim 1, wherein the tip includes a slot having two ends, the first end being open and the second end being closed, the slot also having a flat portion, the drive pin including a recessed area having flat portion, and the flat portion of the tip contacting the flat portion of the drive pin.

5. The wrench apparatus in claim 1, wherein the drive pin further includes a drive pawl for engaging a ratchet wheel to turn the piece driven, the drive pin being operably connected to the drive pawl.

6. The wrench apparatus of claim 5, wherein the drive pawl includes first and second plates which are spaced apart, the first and second plates respectively including first and second openings, the drive pawl further including a support area located at least partially between the first and second plates and supporting the drive pin.

7. The wrench apparatus of claim 6, wherein the support area extends between the first and second plates.

8. The wrench apparatus of claim 6, wherein the support area is spaced apart from at least one of the first and second plates.

9. The wrench apparatus of claim 6, wherein the support area is spaced apart from both of the first and second plates.

10. The wrench apparatus of claim 6, wherein the support area conforms to the exterior surface of the drive pin.

11. The wrench apparatus of claim 6, wherein the support area has a circular arc.

12. A hydraulically operated wrench apparatus, comprising:

a) a housing having a first end accommodating a drive portion, and a second end defining a cylinder portion for housing a piston shaft to engage the drive portion;

b) the drive portion including a drive shaft having a longitudinal axis of rotation;

c) a reciprocating piston shaft housed within the cylinder for operating the drive portion of the wrench as the piston shaft reciprocates, one end of the piston shaft engaging the drive portion and rotating the drive shaft along its longitudinal axis of rotation, the piston shaft having a longitudinal center which intersects at about ninety degrees a vertical line extending from the longitudinal axis of rotation of the drive shaft, the end of the piston engaging the drive portion having a slot;

d) a drive pin being moveable within the slot and moving either increasing or decreasing the vertical distance from the longitudinal axis of rotation of the drive shaft creating a total distance of vertical movement; and d) the longitudinal center of the drive shaft being placed within fifty percent of the total distance of vertical movement.

13. The hydraulic wrench of claim 12, wherein the longitudinal center of the drive shaft being placed within forty percent of the total distance of vertical movement.

14. The hydraulic wrench of claim 12, wherein the longitudinal center of the drive shaft being placed within twenty percent of the total distance of vertical movement.

15. The hydraulic wrench of claim 12, wherein the longitudinal center of the drive shaft being placed within fifteen percent of the total distance of vertical movement.

16. The hydraulic wrench of claim 12, wherein the longitudinal center of the drive shaft being placed within ten percent of the total distance of vertical movement.

17. The hydraulic wrench of claim 12, wherein the longitudinal center of the drive shaft being placed within ten percent of the total distance of vertical movement.

18. The hydraulic wrench of claim 12, wherein the longitudinal center of the drive shaft being placed within five percent of the total distance of vertical movement.

19. The hydraulic wrench of claim 12, wherein the longitudinal center of the drive shaft being placed within two percent of the total distance of vertical movement.

20. The hydraulic wrench of claim 12, wherein the longitudinal center of the drive shaft being placed within one percent of the total distance of vertical movement.

21. A hydraulic wrench apparatus, comprising:

a) a housing having a first end accommodating a drive portion, and a second end defining a cylinder portion;

b) the first end having first and second opposing walls;

c) a drive portion being accommodated in the first end and between the first and second walls, the drive portion including a drive pin having first and second ends;

d) a reciprocating piston shaft housed within the cylinder portion, the piston including a tip, the tip being operably connected to the drive pin;

e) wherein the first and second walls include first and second wear portions, wherein the first and second wear portions protect the first and second walls from wear by the first and second ends of the drive pin.

22. The hydraulic wrench of claim 21, wherein the first and second wear portions are composed of a harder material than the first and second walls.

23. The hydraulic wrench of claim 21, wherein the first and second wear portions are composed of a harder material than the drive pin.

24. The hydraulic wrench of claim 21, wherein the first and second wear portions are composed of a softer material than the drive pin.

25. The hydraulic wrench of claim 21, wherein the first and second wear portions are detachably connected to the first and second walls.

26. The hydraulic wrench of claim 21, wherein the first and second wear portions are coated on the first and second walls.

* * * * *